United States Patent [19]

Mohr

[11] Patent Number: 4,597,717

[45] Date of Patent: Jul. 1, 1986

[54] TWO-STAGE FLUID PUMP

[75] Inventor: Gregory J. Mohr, Hartland, Wis.

[73] Assignee: Truline C.N.C., Inc., Brookfield, Wis.

[21] Appl. No.: 431,015

[22] Filed: Sep. 30, 1982

[51] Int. Cl.[4] ..... F04B 35/04; F04B 27/04; F04B 23/02

[52] U.S. Cl. ..... 417/265; 417/267; 417/271; 417/273; 417/415; 417/440

[58] Field of Search ..... 417/265, 271, 267, 360, 417/415, 273, 252, 440

[56] References Cited

U.S. PATENT DOCUMENTS

| | | | |
|---|---|---|---|
| 1,901,501 | 3/1933 | Ferris | 417/271 |
| 2,018,516 | 10/1935 | Edwards | 417/273 |
| 2,255,851 | 9/1941 | Lundin | 417/273 |
| 2,399,573 | 4/1946 | Rotter et al. | 417/252 |
| 2,450,468 | 10/1948 | Cornelius | 417/265 |
| 2,801,596 | 8/1957 | Sewell | 417/273 |
| 3,053,186 | 9/1962 | Gondek | 417/252 |
| 3,066,610 | 12/1962 | Swanson | 417/415 |
| 3,697,197 | 10/1972 | Berglund et al. | 417/360 |

*Primary Examiner*—Cornelius J. Husar

*Assistant Examiner*—Peter M. Cuomo

*Attorney, Agent, or Firm*—Michael, Best & Friedrich

[57] ABSTRACT

Disclosed herein is a two-stage fluid pump comprising a base member defining a sump, a first fluid pumping unit including a pumping piston and supply and discharge passages, a second fluid pumping unit including a pumping piston and supply and discharge passages, a plate member fixed on the sump and having mounted thereon the first and second fluid pumping units, the plate member including a conduit communicating with the first unit discharge passage and with the second unit supply passage and a discharge conduit communicating with the second unit discharge passage and terminating in a discharge port in the plate member, a drive engaged with the pistons for effecting reciprocation thereof and including an electric motor mounted on the plate member and including an output shaft, a drive member mounted on the plate member for rotation and having an eccentric portion drivingly connected with the pistons to effect reciprocation thereof in response to rotation of the drive member, and a speed reducing mechanism operably connected between the drive member and the electric motor output shaft.

9 Claims, 16 Drawing Figures

TWO-STAGE FLUID PUMP

BACKGROUND OF THE INVENTION

The invention relates generally to portable pumps for delivering hydraulic oil under pressure. More particularly, the invention relates to two-stage portable pumps for delivering oil under pressure.

Attention is directed to U.S. Pat. No. 3,380,392 which discloses a portable hydraulic pump for delivering hydraulic oil under pressure for use with remote jacks or other applications

SUMMARY OF THE INVENTION

The invention provides a two-stage fluid pump comprising a base member defining a sump, a first fluid pumping unit including a pumping piston and supply and discharge passages, a second fluid pumping unit including a pumping piston and supply and discharge passages, a plate member fixed on the sump and having mounted thereon the first and second fluid pumping units, which plate member includes a first conduit communicating with the first unit discharge passage and with the second unit supply passage and a second conduit communicating with the second unit discharge passage and terminating in a discharge port, and a drive engaged with the pistons for effecting reciprocation thereof.

In one embodiment of the invention, the drive comprises an electric motor mounted on the plate member and including an output shaft, a drive member mounted on the plate member for rotation and having an eccentric portion drivingly connected with the pistons to effect reciprocation thereof in response to rotation of the drive member, and a speed reducing mechanism operably connected between the drive member and the electric motor output shaft.

The invention also provides a fluid pump comprising a plate member having a surface and a central bore terminating in the surface, a pair of fluid pumping units each including a housing having a pumping cylinder and a piston reciprocally insertable in and withdrawable from the pumping cylinder, which pair of pumping units is mounted on the surface of the plate member with the pistons respectively extending radially with respect to the central bore and on opposite on sides thereof, and a keeper coupling the pistons for common movement thereof.

In one embodiment of the invention, a rotatable drive member extends through the central bore, and has an eccentric portion, and each of the pistons includes an enlarged head adapted to engage the eccentric driven portion, and the keeper includes connected and spaced legs located between the heads and the housings so as to respectively effect piston withdrawal from each of the housings in response to piston insertion into the other of the housings by the eccentric drive portion.

The invention also provides a two-stage fluid pump comprising a base member defining a sump, a pair of high pressure fluid pumping units each including a housing having therein a pumping cylinder, a piston reciprocally insertable in and withdrawable from the pumping cylinder and including an enlarged head, each of the high pressure pumping units also including supply and discharge passages communicating with the pumping cylinder, a pair of low pressure fluid pumping units each including a housing having therein a pumping cylinder and a piston reciprocally insertable in and withdrawable from the last mentioned pumping cylinder, means biasing the last mentioned piston out of the last mentional pumping cylinder, and supply and discharge passages communicating with the last mentional pumping cylinder, a plate member fixed on the sump, having therein a central bore, having an under surface, and having mounted on the under surface the pairs of fluid pumping units with the high pressure pumping units being oppositely arranged on opposite sides of the bore and with the low pressure pumping units being oppositely arranged on opposite sides of the bore and angularly intermediate the high pressure pumping units, the plate member also including a low pressure conduit communicating with the low pressure unit discharge passages and with the high pressure unit supply passages, a high pressure conduit communicating with the high pressure unit discharge passages and terminating in a discharge port, the plate member also including a face in which the discharge port terminates, the plate member also including a return conduit terminating, at one end, in a return port located in the face in adjacent relation to the discharge port and terminating, at its other end, in a port in the undersurface, the plate member also including a first discharge conduit terminating, at one end, in a first center port located in the face adjacent to and in laterally spaced relation from the discharge port on one side thereof, and, at its other end, in a first remote port located in the face in laterally spaced relation from the first center port, the plate member also including a second discharge conduit terminating, at one end, in a second center port located in the face adjacent to and in laterally spaced relation from the discharge port on the other side thereof, and at its other end, in a second remote port located in the face in laterally spaced relation from the second center port, the plate member also including a by-pass passage communicating between the low pressure conduit and the high pressure conduit and including normally closed check valve means permitting fluid flow from the low pressure conduit to the high pressure conduit and preventing fluid flow from the high pressure conduit to the low pressure conduit, a control valve removably mounted on the face of the plate member and communicable with the discharge port, with the return port, and with the first and second center ports, whereby to enable control of fluid flow to and from the two-stage fluid pump, an electric motor mounted above the plate member and including an output shaft, a drive member extending through the bore and having an eccentric portion engageable with the pistons to effect reciprocation thereof in response to rotation of the drive member, a pinion on the output shaft, an internal ring gear fixed on the plate member, a plurality of gears rotably mounted on the drive member and in simultaneous mesh with the pinion and with the internal ring gear, a keeper including connected and spaced legs located between the heads of the pistons of the high pressure units and the housings of the high pressure units so as to respectively effect high pressure unit piston withdrawal from the high pressure housings in response to high pressure unit piston insertion into said high pressure housings by said eccentric drive portion, a handle connected to the plate member, and an extruded housing member extending between the handle and the plate member and enclosing the motor.

Other features and advantages of the embodiments of the invention will become known by reference to the following general description, claims and appended drawings.

IN THE DRAWINGS

Figure 4:
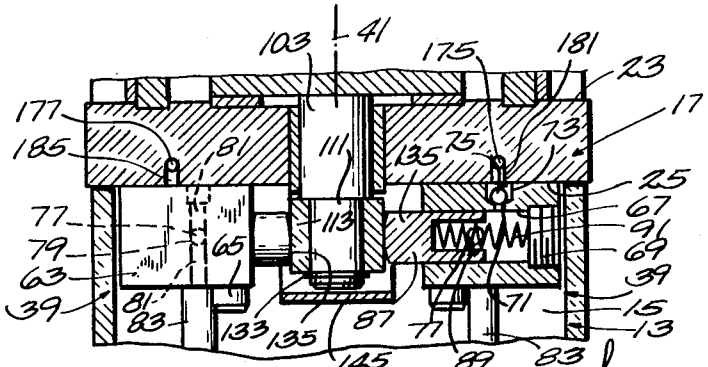
FIG. 4 is a sectional view taken along line 4—4 of FIG. 3.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 1:
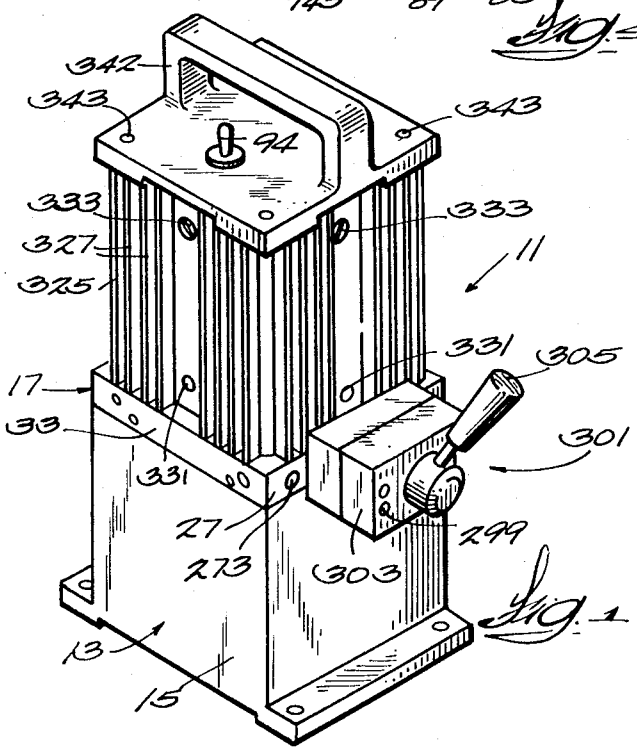
FIG. 1 is a perspective view of a two-stage pump incorporating various of the features of the invention.

Shown in FIG. 1 of the drawings is a portable pedestal type, two-stage fluid pump 11. The pump 11 includes a base member 13 which is generally rectangular, although other shapes could be employed, and which provides the bottom and side walls of an open top sump or reservoir 15.

Secured to the top of the base member 13 in covering relation to the sump 15 is a plate member 17 which is generally rectangular but which could be of other shapes. Sandwiched between the base member 13 and the plate member 17 is a suitable gasket (not shown). The plate member 17 includes an upper surface 23, a lower or under surface 25, a front face 27, a rear face 29, and two side faces 31 and 33.

Figure 3:
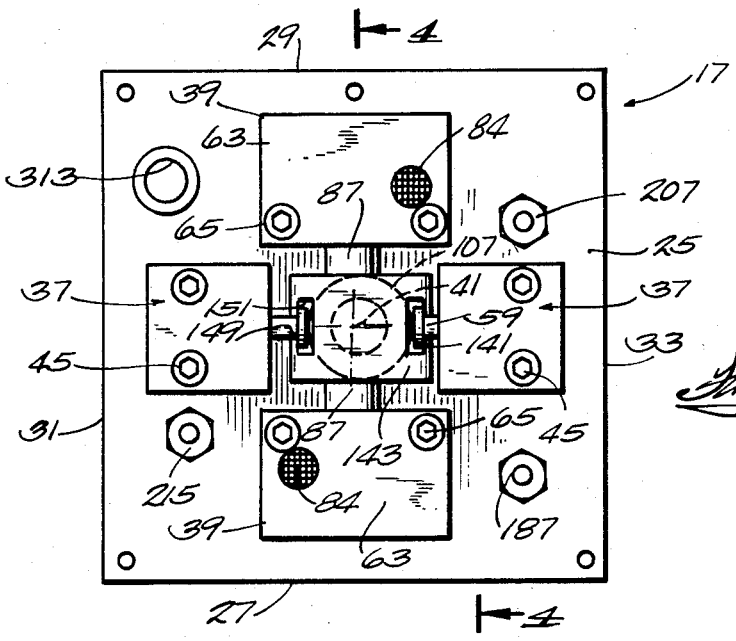
FIG. 3 is a view taken along the line 3—3 of FIG. 2.

Fixed to the under surface 25 of the plate member 17 are (See FIG. 3) a plurality of pumping units. While other configurations are possible, in the disclosed construction, four pumping units are employed, two high pressure pumping units 37 located in opposed relation to each other and two low pressure pumping units 39 located in opposed relation to each other and intermediate the high pressure pumping units 37. The units are thus arranged in a circular disposition at about 90° to each other and about a central axis 41.

Each of the high pressure pumping units 37 is identically constructed and includes (See FIG. 2) a housing member 43 which is suitably secured, as by bolts 45, to the under surface 25 of the plate member 17 and which has a through high pressure pumping bore 47 which provides a pump cylinder, and which extends horizontally and radially from the central axis 41. At its outer end, the high pressure pumping bore 47 is closed by a threaded plug 49. Intersecting the high pressure bore 47 is a vertical discharge passage 51 which extends upwardly to the under surface 25 of the plate member 17 and which includes an upper counter bore 53 receiving a check valve 55 permitting flow from the high pressure bore 47 and preventing back flow to the high pressure bore 47.

Hydraulic fluid is supplied to the high pressure bore 47 by a supply passage 57 which also extends vertically from the high pressure bore 47 to the under surface 25 of the plate member 17 and which is radially inwardly spaced from the discharge passage 53 with respect to the central axis 41.

Extending in the high pressure bore 47 is a high pressure pumping piston 59 which is reciprocated by a drive mechanism 61 back and forth past the supply passage 57 to open and close communication with the supply passage 57. The disclosed ball-check-valve-less arrangement is particularly advantageous in that it avoids the use of intake check valves including seats which are difficult to machine, and subject to wear and contamination leakage.

Each of the low pressure pumping units 39 is of identical construction and includes (See FIG. 4) a housing member 63 which is suitably secured, as by bolts 65, to the under surface 25 of the plate member 17 and which has therein a through low pressure pumping bore 67 which provides a pumping cylinder and which extends horizontally and radially from the central axis 41 and which, at its outer end is closed by a plug 69 which can be threaded or can be an expansion plug pressed into the bore 67. Intersecting the low pressure bore is a vertical discharge passage 71 which extends upwardly to the under surface 25 of the plate member 17 and which includes a counter bore 73 housing a check valve 75 permitting flow from the low pressure bore 67 and preventing back flow to the low pressure bore 67.

Radially inwardly of the discharge passage 71, with respect to the central axis 41, the low pressure bore 67 is intersected by a horizontal supply passage 77 which, at its outer end, is closed by a plug 79 and which, in turn, intersects a vertical supply passage 81 which at its lower end, connects with a vertical stand pipe 83 extending into the sump 15. At its lower end, the stand pipe 83 is open and is preferably provided with a filter 84.

The low pressure bore 67 is of greater diameter than the high pressure bore 47 and receives a low pressure pumping piston 87 which includes an axial bore 89 extending from the radially outer end and receiving a biasing spring 91 which also rests against the plug 69. The low pressure pumping piston 87 is reciprocated by the previously mentioned drive means 61 (which will be explained hereinafter) so as to open and close communication between the supply passage 77 and the low pressure bore 67. Alternatively, a ball-check valve can be employed in one of the components supplying oil, i.e., in the stand pipe 83, or in the passages 77 and 81.

Figure 2:
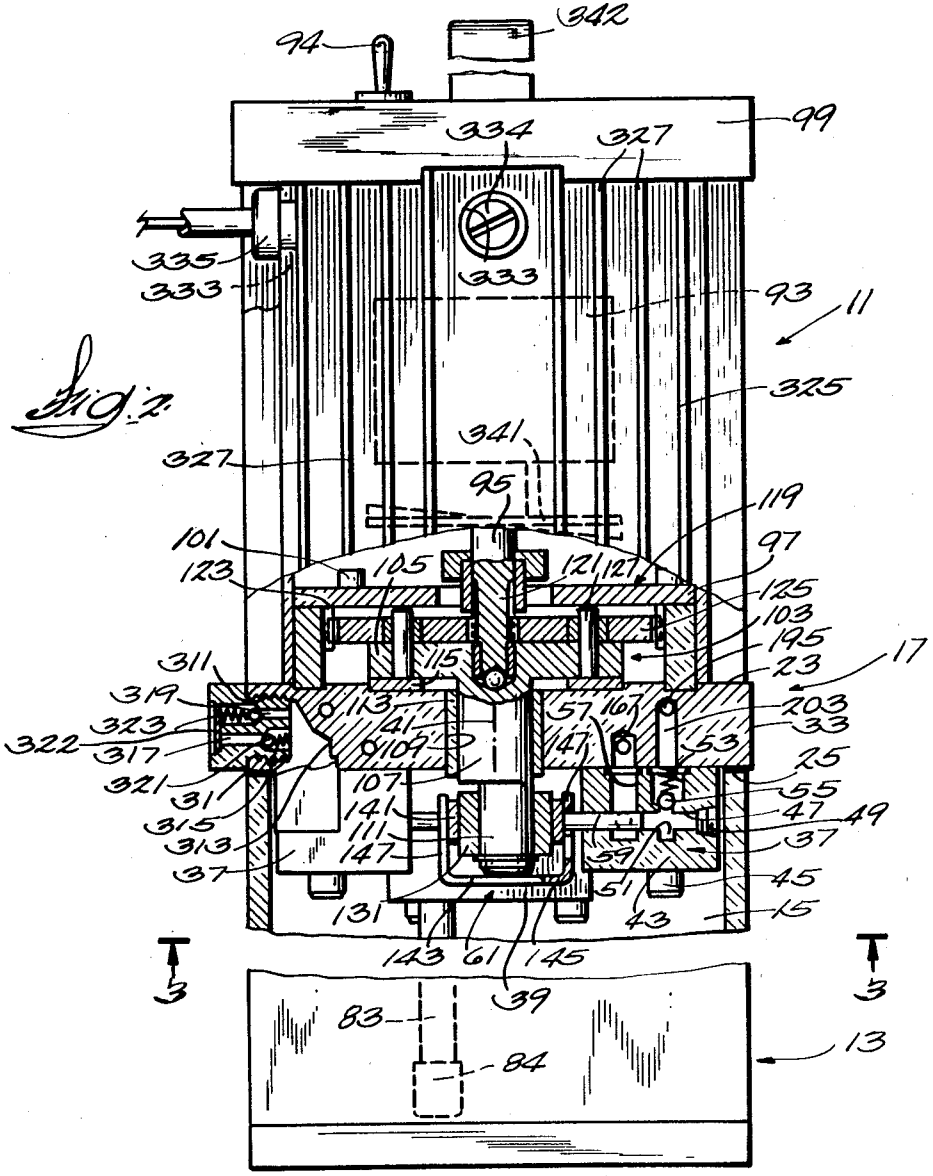
FIG. 2 is a side elevational view, partially broken away and in section, of one face of the pump shown in FIG. 1.

The pumping pistons 59 and 87 are reciprocated, as already indicated, by the drive mechanism 61 which is powered by an electric motor 93 which preferably is a universal motor capable of running on either AC or DC, and which is controlled by a switch 94 (See FIGS. 1 and 2). The motor 93 includes an output shaft 95 and is mounted above the plate member 17 with the output shaft 95 co-axial with the central axis 41. Alternatively, drive to the pump can be provided by an air motor, a gasoline engine, or hydraulic motor.

Various mounting means can be employed. In the disclosed construction, the motor 93 is fixed between lower and upper mounting plates 97 and 99, respectively, which also serve to provide bearings for the output shaft 95. In turn, the lower mounting plate 97 is suitably secured, as by bolts 101, to the plate member 17. The drive mechanism 61 also includes a drive member 103 which is generally of T-shape and includes an upper flange or disc 105, a central hub 107 which extends through a central opening 109 in the plate member 17 and a lower portion 111 which is in eccentric relation to the hub 107 and which is adapted to reciprocate the pumping pistons 59 and 87 in response to rotation of the drive member 103.

A suitable rotary bearing 113 is provided between the hub 107 and the plate member 17 and a suitable bearing 115 is provided between the flange 105 and the upper surface 23 of the plate member 17.

Connecting the output shaft 95 and the drive member 103 is a speed reducing means or coupling or transmission 119. While various constructions can be employed, in the illustrated construction, the speed reducing means 119 comprises a planetary gear train providing a 10 to 1 speed reduction. Of course, any ratio to match the power characteristics of the motor 93 to the requirements of the pump can be employed.

More specifically, the gear train comprises a pinion 121 located on the lower end of the output shaft 95, an internal ring gear 123 which is suitably fixed on the upper surface 23 of the plate member 17, and one or more sun gears 125 (three sun gears in the illustrated construction) which are rotably mounted on studs 127 extending from the drive member flange 105 and which are in simultaneous mesh with the pinion 121 and with the ring gear 123. Accordingly, rotation of the output shaft 95 serves to rotate the drive member 103 at a reduced speed.

The eccentric lower portion 111 of the drive member 103 is provided with an outer bearing 131 which is rotatable thereon. Any suitable means can be employed to retain the bearing 131 on the eccentric lower portion 111. In the disclosed construction, a retaining snap ring 133 is employed. The bearing 131 is directly engaged (See FIG. 4) by the inner ends 135 of the lower pressure pumping pistons 87 (under the action of the springs 91) to afford reciprocation of the pistons 87 in response to rotation of the drive member 103. With respect to each other, the low pressure pistons 87 reciprocate oppositely relative to the housing member 63.

Figure 16:
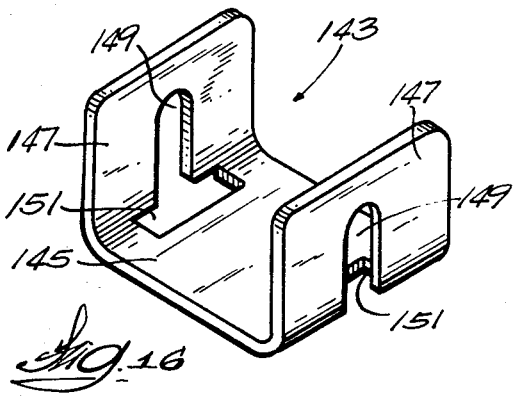
FIG. 16 is an enlarged perspective view of one of the components incorporated in the pump shown in FIG. 1.
Figure 7:
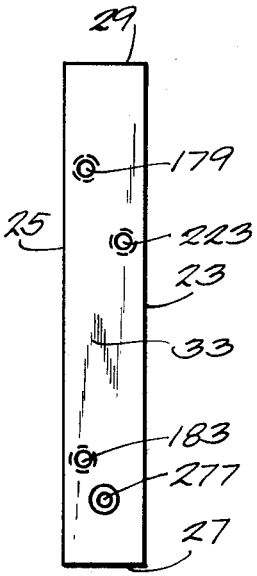
FIG. 7 is an elevational view of one side face of the plate member shown in FIG. 5.
Figure 5:
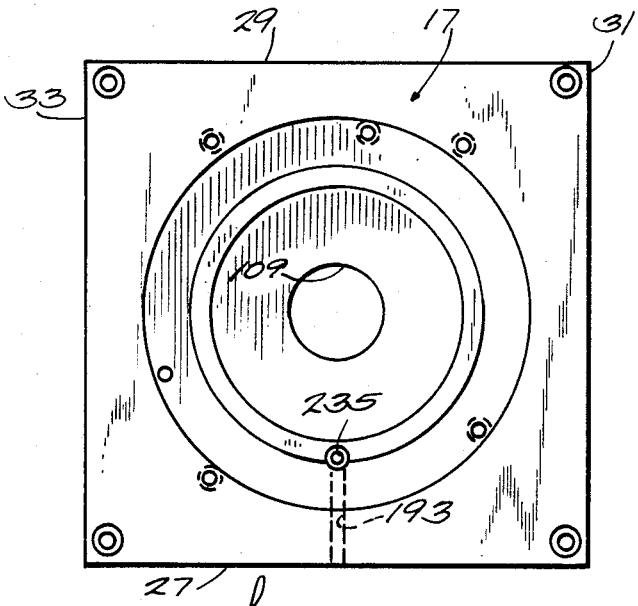
FIG. 5 is a top view of the plate member shown in FIG. 3.
Figure 8:
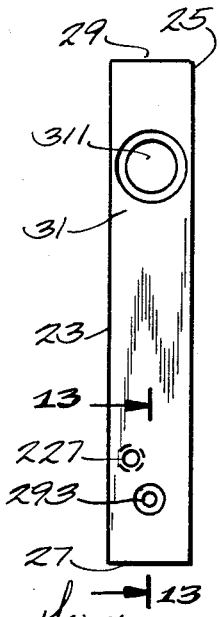
FIG. 8 is an elevational view of the other side face of the plate member shown in FIG. 5.
Figure 6:
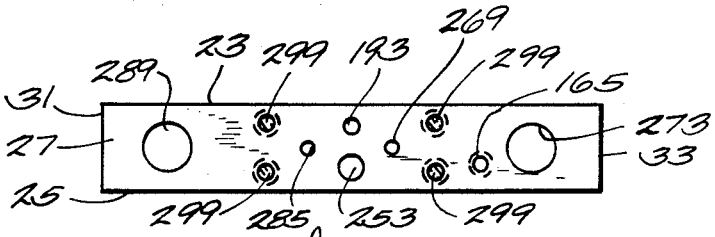
FIG. 6 is an elevational view of the front face of the plate member shown in FIG. 5.
Figure 9:
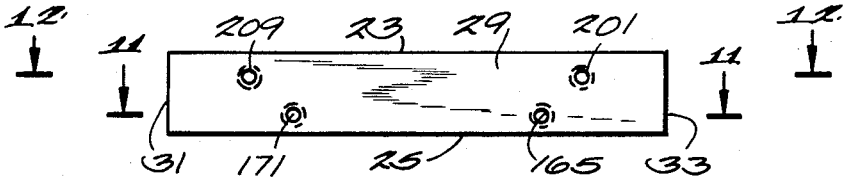
FIG. 9 is an elevational view of the rear face of the plate member shown in FIG. 5.
Figure 10:
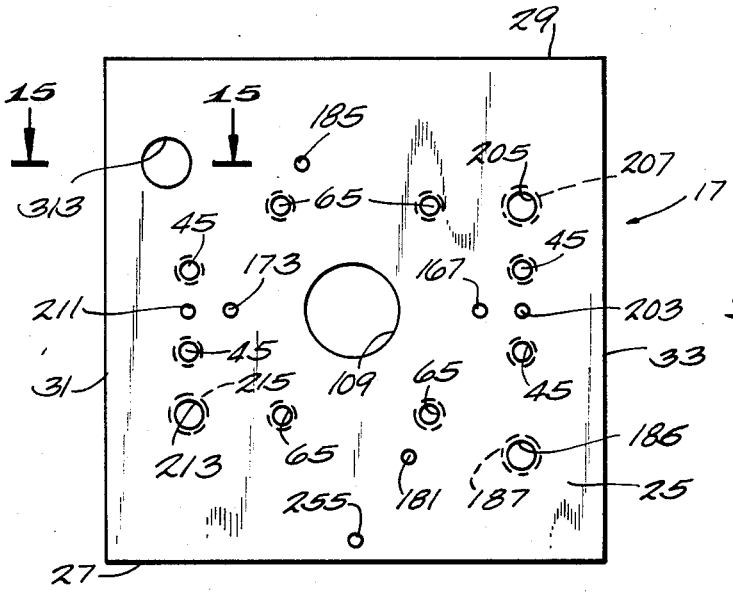
FIG. 10 is a bottom view of the plate member shown in FIG. 5

Positive means are desirably provided for insuring withdrawal of one of the high pressure pumping pistons 59 during insertion of the other of the high pressure pumping pistons 59. Thus, in the disclosed construction, the inner ends of the high pressure pumping pistons 59 are provided (See FIG. 2) with enlarged heads 141 and are coupled together by a keeper or piston puller or coupling member 143. More specifically, the keeper or coupling member 143 is a U-shape and includes (See FIG. 16) a lower horizontal web portion 145 and two vertical legs 147, each leg 147 including (See FIG. 3) a slot 149 which has a width less than the size of the heads 141, which, at its upper end, is closed, and which, at its lower end, opens into an opening 151 in the web portion 145, which opening 151 is of sufficient size to afford passage therethrough of the enlarged piston head 141. The slots 149 and openings 151 also serve to splash oil on the pumping pistons 59 and nearby components, thereby cooling and lubricating these components.

The keeper 143 is located with the high pressure pumping pistons 59 passing through the slots 149 and so that the keeper legs 147 are located between the piston heads 141 and the housing member 43. As a consequence, when one of the high pressure pumping pistons 59 is forceably inserted into its associated bore 47 by reason of engagement of the eccentric portion bearing 131 with the piston head 141, the other high pressure pumping piston 59 is positively withdrawn from its associated bore 47 by engagement of the keeper or coupling member 143 with the backside of the head 141. The piston puller or keeper 143 eliminates the use of springs for biasing the high pressure pistons 59 against the bearing 131, thereby avoiding highly stressed and short lived biasing springs. The keeper 143 also makes possible a more compact design by avoiding use of high pressure biasing springs.

As already noted, the discharge passages 51 and 71 of the high and low pressure pumping units 37 and 39, as well as the supply passage 57 for the high pressure pumping units 37, terminate at the under surface 25 of the plate member 17 which, accordingly, provides a suitable conduit system.

Figure 11:
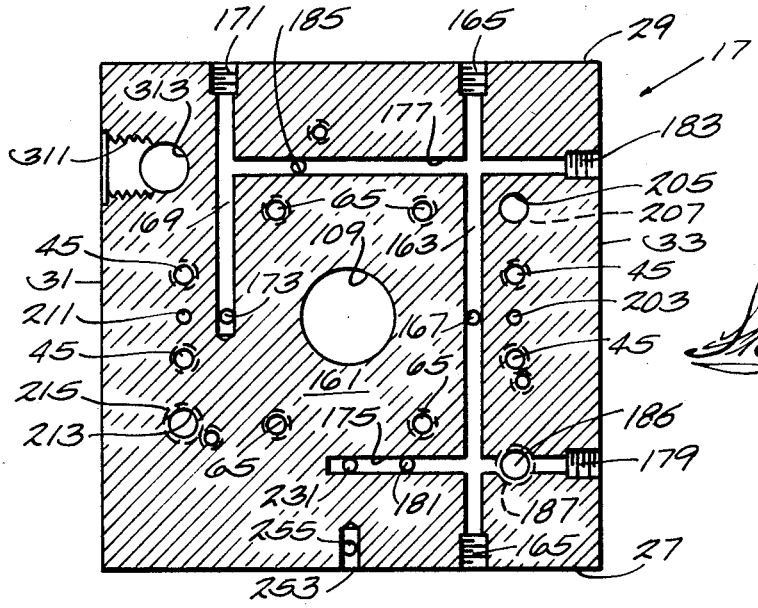
FIG. 11 is a sectional view taken along line 11—11 of FIG. 9.

More particularly, the conduit system includes (see FIG. 11) a low pressure conduit 161 which communicates between the discharge passage 71 of the low pressure pumping units 39 and the supply passages 57 of the high pressure pumping units 37. Still more particularly, the low pressure conduit 161 includes, in the plate member 17, a horizontally extending duct 163 which extends from the front face 27 to the rear face 29 of the plate member 17 and which, at each end, is closed by threaded plugs 165. In addition, the through duct 163 communicates centrally thereof with a vertical branch duct 167 which is aligned with and communicates with the supply passage 57 of one of the high pressure pumping units 37.

Extending parallel to the duct 163 from the rear face 29, is another horizontal duct 169 which, at its inner end, is blind, which, at its end, is closed by a threaded plug 171, and which communicates with a vertical branch duct 173 which is aligned with and communicates with the supply passage 57 of the other of the high pressure pumping units 37.

The low pressure conduit 161 further includes, a pair of spaced, parallel, cross ducts 175 and 177 which extend horizontally from the side face 33. The cross duct 175 intersects the through duct 163, is blind at its inner end, is closed at its outer end by a threaded plug 179 and communicates with a vertical branch duct 181 which is aligned with and communicates with the discharge passage 71 of one of the low pressure pumping units 39. The other cross duct 177 intersects both the duct 163 and the duct 169, is blind at its inner end, is closed at its outer end by a threaded plug 183, and communicates with a vertical branch duct 185 in alignment with and communicating with the discharge passage 71 of the other low pressure pumping unit 39.

The cross duct 175 also communicates with a vertical branch duct 186 which terminates in the lower surface 25 of the plate member 17 and which threadedly receives a low pressure relief valve 187 which, in the event of excessive pressure, dumps into the reservoir or sump 15.

Figure 12:
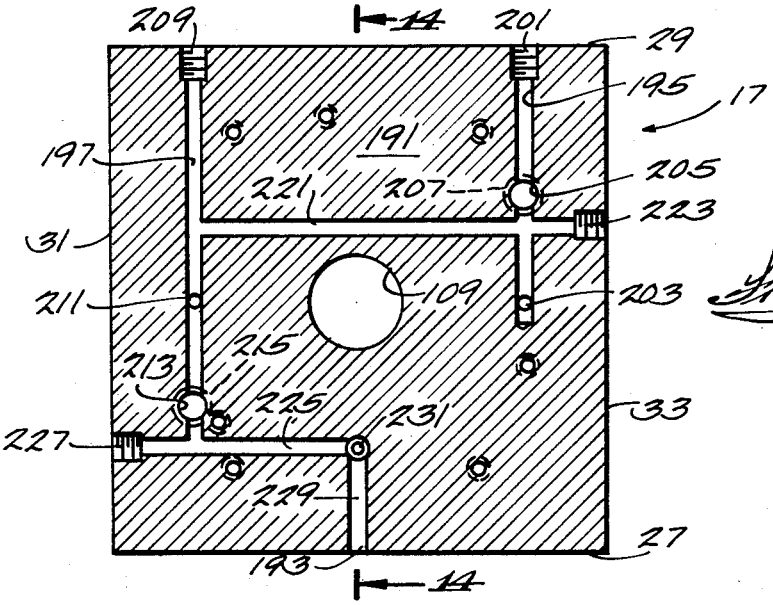
FIG. 12 is a sectional view taken along line 12—12 of FIG. 9

The plate member 17 also includes, as shown in FIG. 12), a high pressure conduit 191 which communicates with the discharge passages 51 of the high pressure pumping units 37 and with a discharge port 193 in the front face 27 of the plate member 17. More particularly, the high pressure conduit 191 includes a pair of parallel ducts 195 and 197 which extend horizontally inwardly from the rear face 29 of the plate member 17. The duct 195 is blind at its inner end, is closed at its outer end by a threaded plug 201, and communicates with a vertical branch duct 203 which is located in alignment with and communicates with the dischage passage 51 of one of the high pressure pumping units 37.

The duct 197 also communicates with a branch port or duct 205 which extends to the lower surface 25 of the plate member 17 and has threadedly receives a high pressure relief valve 207 communicable with the sump 15.

The other parallel duct 197 is also blind at its inner end, is closed at its outer end by a threaded plug, 209, and communicates with a vertical branch duct 211 located in alignment with and communicating with the discharge passage 51 of the other of the high pressure pumping units 37. In addition, the duct 197 communicates with a branch port or duct 213 which extends to the lower surface 25 of the plate member 17 and had threadably received therein a high pressure relief valve 215 communicable with the sump 13.

One of the high pressure relief valves 207 and 215 is fixed for relief at a pressure of about 10,000 p.s.i. and sealed. The other pressure relief valve is adjustable in the field for relief in the area of 10,000 p.s.i., or less.

The high pressure conduit 191 also includes a connecting duct 221 which extends horizontally inwardly from the side face 33, which is blind at its inner end, which, at its outer end, is closed by a threaded plug 223, and which intersects each of the parallel ducts 195 and 197.

In addition, the high pressure conduit 191 includes a horizontal branch connecting duct 225 which extends horizontally inwardly from the side face 31, which is blind at its inner end, which, at its outer end, is closed by a threaded plug 227, and which intersects the duct 197 adjacent its blind inner end.

Still further, in addition, the high pressure conduit 191 includes a duct 229 which extends horizontally inwardly from the from face 27, which is blind at its inner end, which intersects the branch connecting duct 225, and which terminates in the front face 27 in the discharge port 193.

Figure 14:
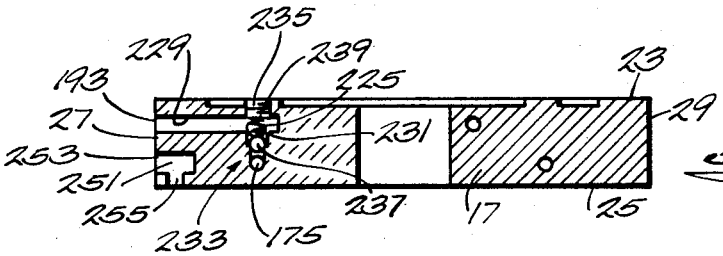
FIG. 14 is a sectional view taken along line 14—14 of FIG. 12.

The conduit system also includes (see FIGS. 11, 12 and 14) a vertical duct 231 which interconnects the high and low pressure conduits 161 and 191, and which includes a check valve 233 permitting flow from the low pressure conduit 161 to the high pressure conduit 191 and preventing flow from the high pressure conduit 191 to the low pressure conduit 161. More particularly, the vertical duct 231 extends vertically from the top surface 23 of the plate member 17, is blind at its lower or inner end, is closed adjacent its upper end by a threaded plug 235, and communicates between the low pressure duct 175 and the intersection of the high pressure ducts 225 and 229. The upper part of the vertical duct 231 is counter bored to accept the check valve 233 which is in the form of a ball 237 and a spring 239 which bears against the ball 237 and against the plug 235. The check valve 233 opens for flow into the discharge duct 229 when sufficient pressure is present in the low pressure conduit 161, i.e., when the pressure ln the low pressure conduit 161 is below the pressure of the low pressure relief valve 187. The check valve 233 closes when the pressure in the high pressure conduit 191 is above the pressure of the low pressure relief valve. The vertical duct 231 also permits fast fill-up of connecting lines leading from the pump 11 to a remote jack (not shown) or the like when there is no load on the remote jack.

The plate member 17 also includes (see FIG. 14) a return duct 251 which includes a return inlet or port 253 immediately below the discharge port 193 on the front face 27 and a return outlet 255 on the under surface 25 of the plate member 17. Specifically, the return duct 251 is defined by two intersecting blind bores.

Figure 13:
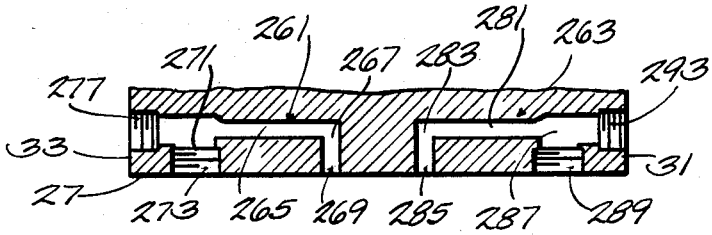
FIG. 13 is a fragmentary sectional view taken along line 13—13 of FIG. 8.

The front face 27 of the plate member 17 also includes (see FIG. 13) first or left and second or right connecting ducts 261 and 263. The first or left connecting duct 261 comprises a horizontal bore or duct 265 which extends inwardly from the side face 33, which, at its inner end is blind, which at its outer end is enlarged and threaded, and which communicates with a horizontal branch duct 267 terminating in a left center port 269 in the front face 27 and with an enlarged horizontal branch duct 271 which terminates in an outer port 273 in the front face 27 and which can be provided with a fitting (not shown) adapted for connection to a connecting line or hose (not shown) leading to a remote jack (not shown) or the like. The outer end of the left connecting duct 261 on the side face 33 is closed either by a threaded plug 277 or by a pressure gauge (not shown) in order to afford indication of the pressure in the left connecting duct 261.

The second or right connecting duct 263 comprises a horizontal bore 281 which extends inwardly from the side face 31, which inner end is blind, which outer end is enlarged and threaded, and which communicates with a horizontal branch duct 283 terminating in a right center port 285 in the front face 27 the other side of the discharge port 193 from the previously mentioned left center duct 269. The duct or bore 281 also communicates with a horizontal branch duct 287 which terminates in an outer port 289 which is located in the front face 27 and which can be provided with a fitting (not shown) adapted for connection to a connecting line (not shown) leading to a remote jack or the like. The outer end of the bore 281 in the siqe face 31 is closed either by a plug 293 or by a pressure gauge (not shown) in order to afford opportunity for the user to determine the pressure in the right connecting duct 263.

Removably attached, as by bolts 299, to the front face 27 of the plate member 17 in covering relation to the discharge port 193, to the return port 253 and to the left and right center ports 269 and 285, is a control valve 301 including a control valve housing 303 and a control handle 305. The control valve housing 303 includes internal conduits (not shown) which communicate with the discharge port 193, and with the return port 253, as well as with the left and right center ports 269 and 285, and with a valve mechanism (not shown) which controls flow from the pump 11 in response to movement of the handle. The control valve 301 is removably attached to the front face 27 in order to facilitate selective use on the two-stage pump 11 of various control valves, as for instance, a two-way, two-position valve which serves to control fluid delivery and return through a single connecting line from one of the left and right outlet ports 269 and 285 to a single acting hydraulic cylinder (not shown).

The control valve 301 can also be a three-way, three-position valve which controls flow through one connecting line to a remote jack, and which includes a center position in which all communication is blocked so as to hold the jack against movement.

The control valve 301 can also be a four-way three-position valve for controlling flow to a double-acting cylinder in which hoses or lines (not shown) extend between the cylinder and each of the left and right outlet ports 269 and. In such a valve, the control handle or member 305 is movable between extend, retract and hold positions.

In addition, the control valve 301 can be a dump valve which omits a control handle, which controls flow through one hose or line (not shown) to a remote single acting cylinder and which operates to extend the cylinder when the motor 93 is energized by the switch 94 and which operates to cause cylinder contraction when the motor 93 is deenergized by the switch 94. Such a dump valve is controlled by operation of the motor switch as compared to the other valves which are manually set in their various positions.

Figure 15:
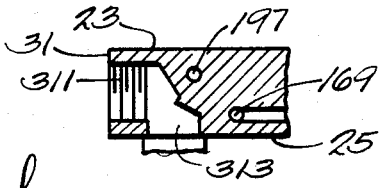
FIG. 15 is a fragmentary sectional view taken along line 15—15 of FIG. 10.

The plate member 17 also includes (See FIG. 15) a combined fill and release system communicating with the sump 15. In this regard, the side face 31 of the plate member 17 includes a blind bore 311 which intersects a blind bore 313 terminating in the under surface 25. The bore 311 is threaded to receive (See FIG. 1) a fitting or nipple 315 which functions as a filler cap, a vacuum breaker, and pressurized air/oil release. The fitting or nipple 315 includes parallel inlet and discharge passages 317 and 319 including respective check valves 321 and 323, which check valves are oppositely operable. Thus, the fitting or nipple 315 can be detachably connected to a source (not shown) of hydraulic fluid which can be pumped into the sump 15 through the passage 317 past the check valve 321, or alternatively the fitting or nipple 315 can be removed to afford filling.

When the pump 11 is operated to supply oil from the sump 15, the inlet passage 317 and associated check valve 321 function to supply make-up air to the sump 15. A filter screen 322 is provided to exclude dirt. On the other hand, should the fluid in the sump 15 become pressurized, as for instance, during lowering of a load with the returning fluid under pressure, the other check valve 323 will afford pressure release and discharge of oil through the passage 319 from the sump 15. Thus, the fitting or nipple operates automatically without operator attention.

The motor 93 is enclosed (See FIGS. 1 and 2) by a housing member 325 which is of generally rectangular configuration, including a plurality of vertically extending parallel fins 327, and which is designed so as to enable fabrication thereof by an extrusion process. The fins 327 add strength to the housing member 325, while minimizing the material and/or weight of the housing member 325, and at the same time, provide a cooling capacity. Several holes can be punched through the housing member 325 to provide for ventilation, for mounting of the motor brushes, and for permitting entry of an electric cord 335 into the interior of the housing member 325. In this last regard, lower ventilation holes 331 are provided adjacent the lower end of the housing member 325 in each of the faces thereof. Ajacent the upper end of the housing member 325 three of the side faces include a central opening 333. Two of the openings 333 located in opposed faces are employed for mounting or providing access to the electric motor brushes 334. Another of the openings 333 is employed for passage into the interior of the housing of the electrical cord 335.

Preferably, a fan blade 341 is also mounted on the motor drive or output shaft 95 above the plate member 17 in order to induce a cooling air flow between the upper vent opening 333 and the lower vent holes 331.

The housing member 325 is retained in position between the plate member 17 and a handle or cover 342 which can integrally extend from the upper mounting plate 99. The handle or cover 342 is connected to the plate member 17 by a series of bolts 343 which pass therebetween inwardly of the outer surface of the housing member 325. Alternatively, the motor 93 can be fastened to the plate member 17 and the cover or handle 342 fixed to the motor 93 to retain the housing member 325 in position. The cover or handle 342 and the upper mounting plate 97 can be a single part. As shown the switch 94 is mounted on the cover 342. Other locations can also be employed.

In operation, rotation of the drive member 103 by the electric motor 93 serves to simultaneously reciprocate the high and low pressure pumping pistons 59 and 87. The reciprocation of the low pressure pumping pistons 87 causes oil to be elevated through the stand pipes 83 from the sump 15 and to be delivered past the check valves 75 into the low pressure conduit 161. From the low pressure conduit 161, such low pressure oil is delivered to the supply passages 57 of the high pressure pumping units 37 and is introduced into the high pressure pumping bores 47 in response to reciprocation of the high pressure pumping pistons 59 and without the need for check valves. Such reciprocation also forces the hydraulic oil out through the discharge passages 51 and past the check valves 55 into the high pressure conduit 191. The high pressure conduit 191 terminates, as already explained, at the front face 27 in the discharge port 193 which is located above the return port 253. As also already described, left and right center ports 269 and 285 are also provided in the front face 27, all of which communicate with one of several control valves 301 which are adapted to control the output from the two-stage pump 11 in accordance with the setting of the control valve handle 305 or in accordance with electrical energization of the motor 93.

The plate member 17 also includes, as already indicated, fill and release passages 317 and 319 communicating with the sump 15. It is particularly noted that all of the passages between the pumping units 37 and 39 and the control valve 301 are located in the plate member 17. It is also particularly noted that the high pressure pumping pistons 59 are positively displaced and withdrawn from their respective bores or cylinders 47. Still further, it is noted that the housing member 325 is of extruded configuration and provides economy in construction while affording cooling of the fins and exterior replacement of the motor brushes. Still further in addition, it is noted that the housing member 325 can vary in length, depending on the size of the motor 93 and whether auxiliary circuitry or controls are desired or required in accordance with intended usage.

It is further noted that because of the employment of the keeper 143, employment of springs in the high pressure pumping units 37 is avoided, thereby also avoiding problems with respect to spring life and power loss. In addition, in the absence of springs and the accompanying length requirement associated with spring length, the enlarged heads 141 and keeper 143 provide a compact design.

Still further in addition, the radial array of pumping units 37 and 39 facilitates variation in pumping characteristics to accommodate different pumping flow parameters. In this regard, the two plus two arrangement of high and low pressure pumping units 37 and 39 permits variation in design of either one of the high and low pressure pumping units 37 and 39 without changing the other. Still, further, the individual pump housings 43 and 63 permit replacement of one unit independently of the other units.

Still further in addition, the arrangement of the high and low pressure conduits 161 and 191 in vertically spaced planes within the plate member 17 facilitates use of a member of relatively thin depth and also eliminates costly and leak prone connections, fittings, tubings, and the like.

The front face port configuration allows for interchangeability with respect to the control valves 301 without requiring interconnecting adapters, fittings, tubings, or the like. Furthermore, such interchangeability can be easily accomplished in the field or by distributors or dealers without requiring extensive stocking of pumps dedicated to one particular type of control valve. Thus, inventory levels can be reduced, while still affording anticipation of customer needs.

In addition, the design of the plate member 17 allows for the use of pressure gauges without additional tools, fittings or other connections.

It is noted further that the intake and relief fitting or nipple 315 is built as one complete unit and is operable to afford automatic venting of the sump 15 without operator control in the event the sump or reservoir 15 is over-filled, thereby eliminating need for additional safety valves or blowout plugs. The fitting 315 also provides for leak-proof travel or transit from one place to another without attention from the operator.

Attention is also directed to the fact that the extruded condition of the motor housing member 325 eliminates the need for increased inventory to cover a range of motor sizes. The manufacturer can merely cut the extruded shape to the length required for the particular motor size being built. In addition, the axial cooling fins 327 can be internal or external or both and are bascially obtained without cost by reason of the extrusion process. The end cap or cover 341 for the extruded housing member 325 can be any structure adapted for the desired application, such as a simple end cap, a combination cap and handle as shown, a box structure to contain electrical or electronic conrols, or an end cap mounting plate, or otherwise.

Still further, the access holes 331 and 333 for cooling and electrical connections can be added with single or multiple punching operations without need for expensive die casting or machining operations.

Still further, interior additional gear reducers other than as disclosed can be contained in the extruded housing members merely by varying the length of the extrusion as may be necessary.

In addition, electrical boxes for additional motor control can be located in the extruded housing member 325 in modular fashion simply by extending the length of the extruded housing member 325.

The end cap or cover 341 for the extruded housing member 325 can be any structure required for the design application such as a simple end cap, a combination end cap and handle as shown, or an end cap mounting plate, or otherwise.

Various of the features of the invention are set forth in the following claims:

I claim:

1. A two stage fluid pump comprising a base member defining a sump, a first fluid pumping unit including a pumping piston and supply and discharge passages, a second fluid pumping unit including a pumping piston and supply and discharge passages, a plate member fixed on said sump and having mounted thereon said first and second fluid pumping units, said plate member including a first conduit communicating with said first unit discharge passage and with said second unit supply passage, a second conduit communicating with said second unit discharge passage and terminating in a discharge port, an undersurface, a face in which said discharge port terminates, a return conduit terminating, at one end, in a return port locating in said face in adjacent relation to said discharge port and terminating, at its other end, in an outlet port in said undersurface, a first discharge conduit terminating, at one end, in a first center port located in said face adjacent to and in laterally spaced relation from said discharge port on one side thereof, and, at its other end, in a first remote port located in said face in laterally spaced relation from said first center port, and a second discharge conduit terminating at one end, in a second center port located in said face adjacent to and in laterally spaced relation from said discharge port on the other side thereof, and, at its other end, in a second remote port located in said face in laterally spaced relation from said second center port, and a drive engaged with said pistons for effecting reciprocation thereof.

2. A two-stage pump in accordance with claim 1 wherein said plate member includes another face and wherein one of said first and second discharge conduits includes a duct terminating in a port located in said other face.

3. A two-stage fluid pump in accordance with claim 1 and further including a control valve removably mounted on said plate member.

4. A two-stage fluid pump comprisihg a base member defining a sump, a pair of high pressure fluid pumping units each including a housing having therein a pumping cylinder, a piston reciprocally insertable in and withdrawable from said pumping cylinder and including an enlarged head, each of said high pressure pumping units also including supply and discharge passages communicating with said pumping cylinder, a pair of low pressure fluid pumping units each including a housing having therein a pumping cylinder and a piston reciprocally insertable in and withdrawable from said last mentioned pumping cylinder, means biasing said last mentioned piston out of said last mentioned pumping cylinder, and supply and discharge passages communicating with said last mentioned pumping cylinder, a plate member fixed on said pump, having therein a central bore, having an undersurface, and having mounted on said undersurface said pairs of fluid pumping units with said high pressure pumping units being oppositely arranged on opposite sides of said central bore and with the low pressure units being oppositely arranged on opposite sides of said bore and angularly intermediate said hgh pressure pumping units, said plate member also including a low pressure conduit communicating with said low pressure unit discharge passages and with said high pressure unit supply passages, and a high pressure conduit communicating with said high pressure unit discharge passages and terminating in a discharge port, said plate member also including a face in which said discharge port terminates, said plate member also including a return conduit terminating, at one end, in a return port locating in said face in adjacent relation to said discharge port and terminating, at its other end, in a port in said undersurface, said plate member also including a first discharge conduit terminating, at one end, in a first center port located in said face adjacent to and in laterally spaced relation from said discharge port on one side thereof, and, at its other end, in a first remote port located in said face in laterally spaced relation from said first center port, said plate member also including a second discharge conduit terminating, at one end, in a second center port located in said face adjacent to and in laterally spaced relation from said discharge port on the other side thereof, and at its other end, in second remote port located in said face in laterally spaced relation from said second center port, said plate member also including a by-pass passage communicating between said low pressure conduit and said high pressure conduit and including normally closed check valve means permitting fluid flow from said low pressure conduit to said high pressure conduit and preventing fluid flow from said high pressure conduit to said low pressure conduit, a control valve removably mounted on said face of said plate member, an electric motor mounted above said plate member and including an output shaft, a drive member extending through said bore and having an eccentric portion engageable with said pistons to effect reciprocation thereof in response to rotation of said drive member, a pinion on said output shaft, an internal ring gear fixed on said plate member, a plurality of gears rotably mounted on said drive member and in simultaneous mesh with said pinion and with said internal ring gear, a keeper including connected and spaced legs located between said heads of said pistons of said high pressure units and said housings of said high pressure units so as to respectively effect high pressue unit piston withdrawal from each of said high pressure unit housings in response to high pressure unit piston insertion into the other of said high pressure unit housings by said eccentric drive portion, a handle connected to said plate member, and in extruded housing member extending between said handle and said plate member and enclosing said motor.

5. A two-stage pump in accordance with claim 4 wherein said plate member also includes another face having therein a side port, and a bottom port in said undersurface communicating with said side port, and further including a fitting removably received in said side port and including a supply passage including normally closed check valve means permitting fluid flow into said pump and preventing fluid flow from said pump, and a vent passage including normally closed check valve means permitting fluid flow from said pump and preventing fluid flow into said pump.

6. A two-stage pump in accordance with claim 4 wherein said plate member includes another face and wherein one of said first and second discharge conduits includes a duct terminating in a port located in said other face.

7. A two-stage fluid pump in accordance with claim 4 wherein said housing member has a surface including a plurality of spaced apart, elongated parallel cooling fins extending between said handle and said plate member.

8. A two-stage fluid pump in accordance with claim 7 wherein said housing member also includes a plurality of holes spaced apart in the direction of elongation of said fins and permitting air flow to and from the interior of said housing member.

9. A two-stage fluid pump in accordance with claim 8 and further including a fan member located interiorly of said housing member and driven by said output shaft so as to induce cooling air flow within said housing member.

* * * * *